US005116206A

United States Patent [19]

Adahan

[11] Patent Number: 5,116,206

[45] Date of Patent: May 26, 1992

[54] PORTABLE FLUID PUMPING DEVICE

[76] Inventor: Carmeli Adahan, Netivei Am 11, Ramot Gimmel, 97552 Jerusalem, Israel

[21] Appl. No.: 625,339

[22] Filed: Dec. 11, 1990

[51] Int. Cl.[5] ..... F04B 39/12; F16J 1/04

[52] U.S. Cl. ..... 417/234; 417/440; 92/240

[58] Field of Search ..... 92/240; 417/440, 234, 417/571, 415; 137/526; 222/383, 384

[56] References Cited

U.S. PATENT DOCUMENTS

| | | | |
|---|---|---|---|
| 2,557,536 | 6/1951 | Drane | 137/526 |
| 3,062,601 | 11/1962 | Sadler | 92/240 |
| 3,142,299 | 7/1964 | Henderson | 222/383 |
| 3,610,782 | 10/1971 | McGuire | 417/415 |
| 3,776,666 | 12/1973 | Ludwig | 417/411 |
| 3,989,415 | 11/1976 | Van-Mee | 417/312 |
| 4,540,352 | 9/1985 | Becker | 417/571 |
| 4,604,539 | 8/1986 | Bertram | 310/81 |
| 4,848,213 | 7/1989 | Wood | 92/172 |

*Primary Examiner*—Richard A. Bertsch
*Attorney, Agent, or Firm*—Benjamin J. Barish

[57] ABSTRACT

A portable fluid pumping device includes a piston-cylinder drive in which the piston head is formed with a central section of smaller diameter than the cylinder, and a peripheral flexible section slidably engageable with the side wall of the piston, to thereby produce a slidable seal which obviates the need of a rolling diaphragm. The device further includes a noise-muffling construction, a relief valve presettable for presetting the degree of suction, and a detachable collection container having a cut-off valve for disconnecting the container when it is full with liquid.

14 Claims, 4 Drawing Sheets

PORTABLE FLUID PUMPING DEVICE

BACKGROUND OF THE INVENTION

The present invention relates to portable pumping devices capable of operating either as a suction pump or as a compressor. The invention is particularly applicable to the portable fluid pumping devices described in my prior U.S. Pat. No. 4,726,745, and is therefore described below with respect to this type of device.

My U.S. Pat. No. 4,726,745 discloses a portable pumping device particularly useful as a medical suction pump for drawing off waste fluids. The pumping device described in that patent is now in production, but one of its drawbacks is that it requires a rolling diaphragm between the piston and cylinder. Rolling diaphragms, however, degrade with time and deform under pressure to introduce "dead" piston travel which stretches the diaphragm without displacing air. Such pumps, therefore, require frequent replacement of the diaphragm.

In addition, pumps of this type are extremely noisy at the exhaust end when operating as a suction pump, and at the air-intake end when operated as a compressor. Furthermore, when such pumps are operated as a compressor, the air entering the pump or exiting from it has to be filtered, and providing an external filter is both costly and cumbersome.

OBJECTS AND SUMMARY OF THE PRESENT INVENTION

An object of the present invention is to provide a portable fluid pumping device of a construction which obviates the need of a rolling diaphragm.

Another object of the present invention is to provide a portable fluid pumping device of a construction which reduces the level of noise produced during the operation of the device.

A further object of the invention is to provide a portable fluid pumping device which includes a relief valve of a construction enabling convenient presetting the degree of suction producible in the collection container.

A further object of the present invention is provide a portable fluid pumping device including a collection container having a cut-off valve effective to disconnect the collection container from the pumping device whenever the collection container becomes full with liquid.

A further object of the invention is to provide a portable fluid pumping device including a collection container which enables the collection container to be conveniently attached to or detached from the pumping device.

A still further object of the invention is to provide a portable fluid pumping device which may be constructed with relatively few simple parts, and which therefore can be produced in volume and at low cost.

According to one aspect of the present invention, there is provided a portable fluid pumping device comprising: a pump housing having a fluid inlet port, a fluid outlet, port, a passageway between the ports, and a cylinder in the passageway; a piston having a piston stem and a piston head reciprocatable within the cylinder; a valve assembly in the passageway to produce a positive pressure at one of the ports and a negative pressure at the other of the ports; and a drive coupled to the piston stem for reciprocating the piston head within the cylinder. The piston head includes a central section of smaller diameter than the inner diameter of the cylinder, and a peripheral flexible section slidably engageable with the side wall of the cylinder during the reciprocation of the piston. The drive includes an electric motor having a rotary drive shaft, and an eccentric bearing freely received on the rotary drive shaft and eccentrically coupling the rotary drive shaft to the piston stem, the longitudinal axis of the rotary drive shaft being offset with respect to the longitudinal axis of the cylinder.

It has been found that a portable fluid pumping device constructed in accordance with the foregoing features produces a very effective slidable seal between the piston and the cylinder, and therefore obviates the need for a rolling diaphragm.

According to further features in the preferred embodiment of the invention described below, the housing includes a plurality of feet for supporting the pump housing on a supporting surface with the bottom of the so-supported housing spaced above the supporting surface. The port at which the positive pressure is produced is located at the raised bottom of the housing and is connected to the valve assembly by at least one bend, and preferably a plurality of bends, in the passageway. Such a construction has been found to substantially reduce the noise produced during the operation of the device.

According to further features in the preferred embodiment of the invention described below, the device also includes a relief valve having presettable means for presetting the degree of suction producible in the pump housing. More particularly, the presettable means comprises an opening in the pump housing; a plug slidably and rotatably movable within the opening and carrying a sealing ring on the end of the plug disposed within the pump housing; and an arched leaf spring fixed at its center to the plug so as to rotate therewith, and having outer ends engageable with the outer face of the pump housing around the opening. The outer face of the pump housing around the opening is formed with a projecting formation projecting at different heights from the surface of the pump housing such that rotation of the plug causes the outer ends of the leaf spring to engage different portions of the projecting formation and thereby presets the negative pressure produced at the negative-pressure port by presetting the outward force applied by the leaf spring to the plug in opposition to the inward force applied to the plug by the suction in pump housing.

According to still further features in the preferred embodiment of the invention described below, a collection container is provided which includes a cut-off valve effective to disconnect a first negative-pressure port of the collection container from the negative-pressure port of the pump housing. More particularly, the cut-off valve comprises a strip of elastomeric material mounted at one end in cantilever fashion on the inner face of the collection container with the opposite end underlying the first port, such that when the collection container becomes full with liquid, the liquid will displace the opposite end of the elastomeric strip against the wall of the collection container to close the first port.

According to still further features in the described preferred embodiment, the pump housing is formed with a pair of recesses in its outer surface at opposite sides of the housing, and the collection container includes a pair of projecting ribs slidably receivable in the recesses for removably attaching the collection container to the pump housing.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

The Embodiment of Figs. 1–5

Figure 1:
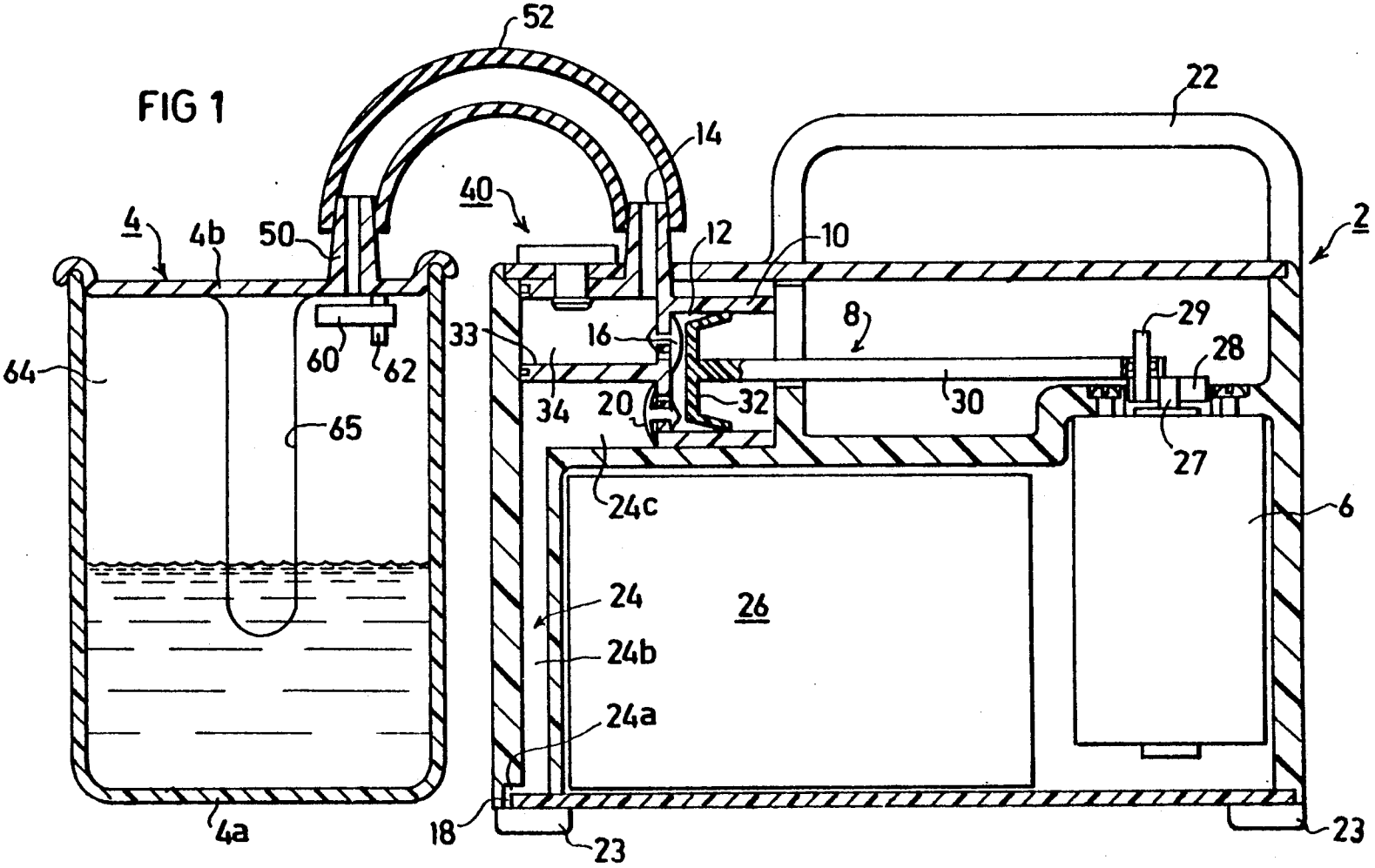
FIG. 1 is a longitudinal sectional view illustrating one form of portable fluid pumping device including an attached collection container constructed in accordance with the present invention.

The pumping device illustrated in FIGS. 1–5 is intended for use as a portable suction pump for medical applications, such as for drawing off waste carried by the pump. The illustrated suction pump includes a pump housing 2 and a detachable liquid collection container 4 into which the liquids are The suction pump is operated by an electric motor 6 in the pump housing 2. Motor 6 reciprocates a piston 8 within a cylinder 10 defining a pumping chamber 12. It be seen that rightward reciprocations of piston 8 produces a negative pressure within chamber 12, whereas leftward reciprocations of the piston produce a positive pressure in that chamber. Chamber 12 is in a passageway which communciates with a first port 14 via a one-way umbrella valve 16; valve 16 opens during the rightward reciprocations of piston 8 to produce a negative pressure at port 14. Chamber 12 also communciates with a second port 18 via a second one-way umbrella valve 20 which opens during the leftward reciprocations of piston 8 to produce a positive pressure at port 18.

The illustrated pumping device is designed for convenient portability. Accordingly, the pump housing 2 includes a handle 22 and a plurality of feet 23 for supporting the housing on a flat supporting surface with the bottom of the housing raised above the surface. The pump housing 2 further includes a compartment for holding a battery 26 powering the motor 6.

The positive-pressure port 18 is located in the bottom wall of the pump housing 2, and is connected to its one-way valve 20 via a passageway 24 which includes three bends 24*a*, 24*b*, 24*c*. Most of the noise generated by suction pumps is at the exhaust end, and it has been found that this construction substantially reduces the level of the noise produced during the operation of the pump.

Motor 6 which drives piston 8 includes an output rotary shaft 27 which receives an eccentric bearing 28 coupled by pin 29 to stem 30 of piston 8. Stem 30 is fixed to piston head 32 reciprocatable in cylinder 10. The axis Am (FIG. 2) of motor 6 is offset somewhat from the axis Ac of the cylinder 10. The eccentric bearing 28 is freely received (i.e., without fasteners) around the rotary drive shaft 27 of the motor 6.

Figure 3:
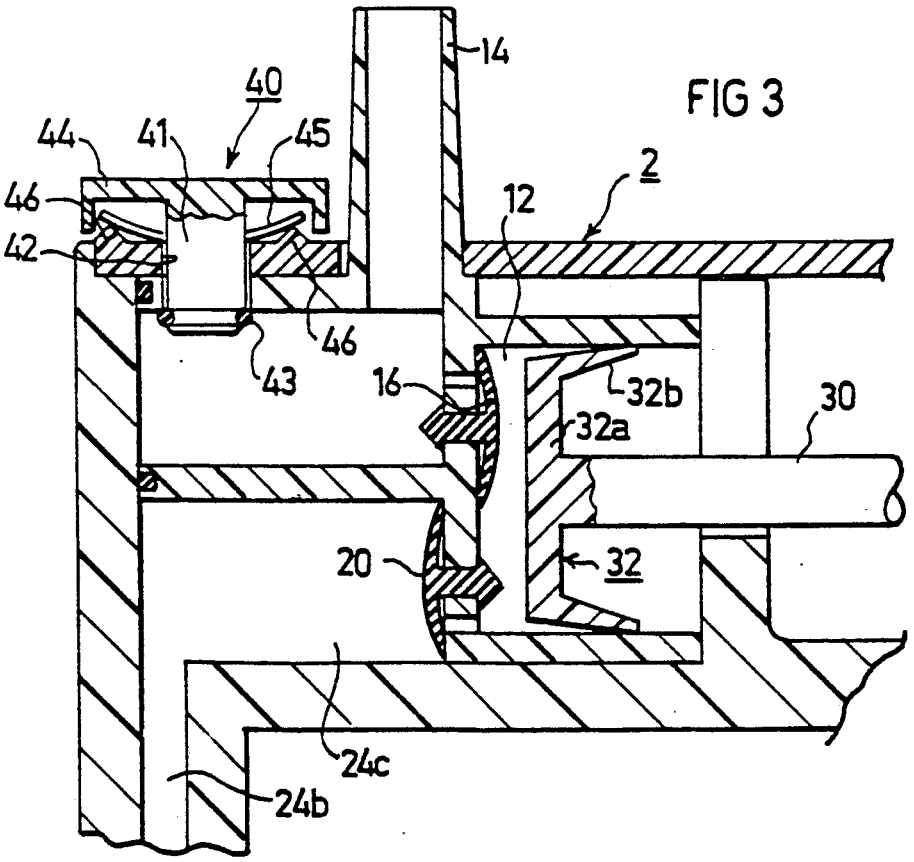
FIG. 3 is an enlarged fragmentary view of a portion of the pumping device of FIG. 1.

As shown particularly in FIG. 3, piston head 32 is formed with a central rigid section 32*a* of smaller diameter than the inner diameter of cylinder 10, and with a peripheral flexible section 32 slidably engageable with the side wall of the cylinder during the reciprocations of the piston. The peripheral flexible section 32*b* is of frusto-conical configuration, and is of smaller thickness than the central rigid section 32*a*. Preferably, section 32*b* continuously decreases in thickness to its outer tip, so as to form a flexible lip engageable with the inner face of cylinder 10 during the reciprocations of the piston.

It has been found that in such a construction, the outer peripheral section 32*b* of the piston head 32 forms an expansible lip producing an effective sliding seal with the cylinder 10, and thereby obviates the need for a rolling diaphragm or other separate seal. In this construction, the piston 30 "wobbles" during its reciprocations by motor 6 and eccentric bearing 28, and the free mounting of the eccentric bearing to the motor shaft, together with the offset between the motor axis Am and cylinder Ac, keeps the piston aligned with the cylinder particularly during the compression stroke when the forces on the piston are greatest.

The assembly of the two one-way valves 16, 20 includes a partition 33 which divides this portion of the passageway between cylinder 10 and the two ports 14, 18, into the previously-mentioned positive-pressure section 24 leading to port 18, and a negative-pressure section or chamber 34 leading to port 14. Chamber 34 includes a presettable device, generally designated 40, which enables presetting the vacuum produced at the negative-pressure port 14.

Figure 3A:
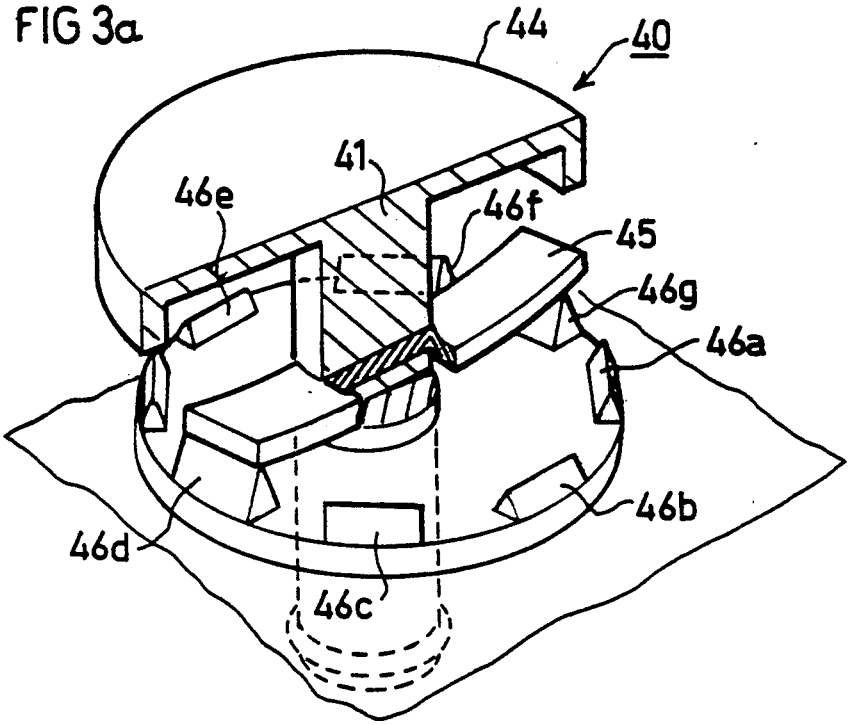
FIG. 3*a* is an enlarged fragmentary view of a part of FIG. 3.

Presettable device 40, as more particularly illustrated in FIGS. 3 and 3*a*, comprises a cylindrical plug 41 slidably and rotatably movable within a cylindrical opening 42 formed in the pump housing 2. The inner end of plug 41 carries a sealing ring 43 normally engageable with the inner face of housing 2. The outer end of the plug carries an enlarged knob 44 permitting the plug to be manually rotated within opening 42.

The presettable device 40 further includes an arched, rectangular leaf spring 45 passing through an opening in the outer end of plug 41 so as to be rotatable with the plug. The outer ends of leaf spring 45 engage a projecting formation 46 formed in the outer surface of the pump housing 2 around opening 42. Projecting formation 46 is in the form of a plurality of discrete projections 46*a*–46*f* of different heights arranged in a circular array around opening 42.

It will thus be seen that the height of the projections 46 engaging the ends of the leaf spring 45 will determine the outward force applied by the leaf spring to plug 41, and therefore the degree of vacuum required to be produced within chamber 34 (FIG. 1) in order to overcome this force and to pull the plug inwardly to unseat seal 43. Accordingly, so long as the vacuum within chamber 34 is less than that preselected by the rotary position of plug 41, seal 43 will be firmly pressed by the leaf spring 45 against the inner surface of the housing to seal opening 42. However, whenever the vacuum exceeds the preset value, the vacuum will draw plug 41 inwardly, against the force of the leaf spring 45, to unseat seal 43, and thereby to release the vacuum within chamber 34 until the vacuum reaches the level preset by plug 41.

The negative-pressure port 14 of the pump housing 2 is connected to a negative-pressure port 50 (FIG. 1) in the liquid collection container 4 via a flexible tube 52. As shown particularly in FIG. 4, liquid collection container 4 includes a second negative-pressure port 54 adapted to be connected to an external object, e.g., for drawing waste liquids from a person by suction.

The liquid collection container 4 further includes a shut-off valve 60 effective to shut-off port 50 of the collection container 4 from port 14 of the pump housing 10 in case the liquid accumulated within container 4 rises to the level of port 50. This is to prevent liquid from being drawn into the pump when the collection container is full. Shut-off valve 60 is in the form of a strip of elastomeric material mounted at one end in cantilever fashion to the inner face of the collection container 4 by means of a stem 62. The opposite end of elastomeric strip 60 underlies port 50 so that when container 4 becomes full of liquid, the liquid will displace the opposite end of the elastomeric strip against the wall of the container to thereby close port 50, and thereby prevent liquid from being drawn into the pump housing 2.

The illustrated construction has been found to be more reliable than the common float type shut-off valve. Thus, the common float shut-off valve is influenced somewhat by gravity when the container is tilted on the side, and therefore could shut-off prematurely. However, the illustrated cantilevermounted elastomeric strip is not affected by gravity. Accordingly, this construction is not only simpler and less costly, but is also more reliable particularly when the collection container is tilted.

The liquid collection container 4 is made of a main section 4*a* and a cover section 4*b*, both of injection-moulded plastic material. The main section 4*a* is molded with a plurality of partitions 64 extending for the complete width and complete height of the container, so as to divide its interior into a plurality of compartments 64*a*, 64*b*, 64*c*. In such a construction, the partitions 64 reinforce the container and thereby enable it to be constructed of relatively thin walls. Each of the partitions 64, however, is formed with an elongated slot 65 starting from its upper end but terminating short of its lower end, to enable the liquid accumulating in the container to flow from one compartment to the other until all the compartments are full.

Figure 2:
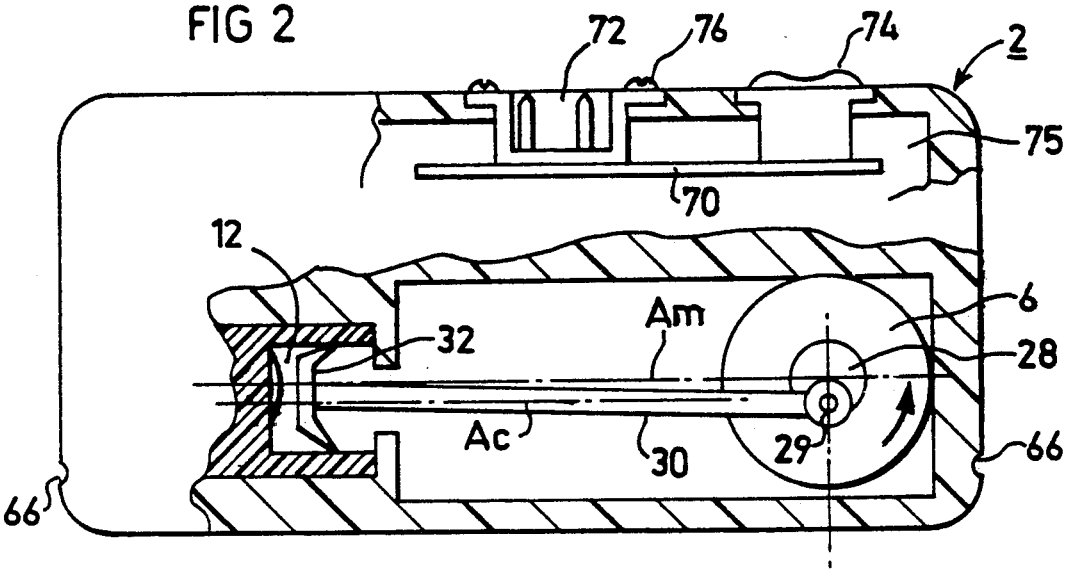
FIG. 2 is a top plan view partly in section more particularly illustrating the construction of the pumping device of FIG. 1.
Figure 5:
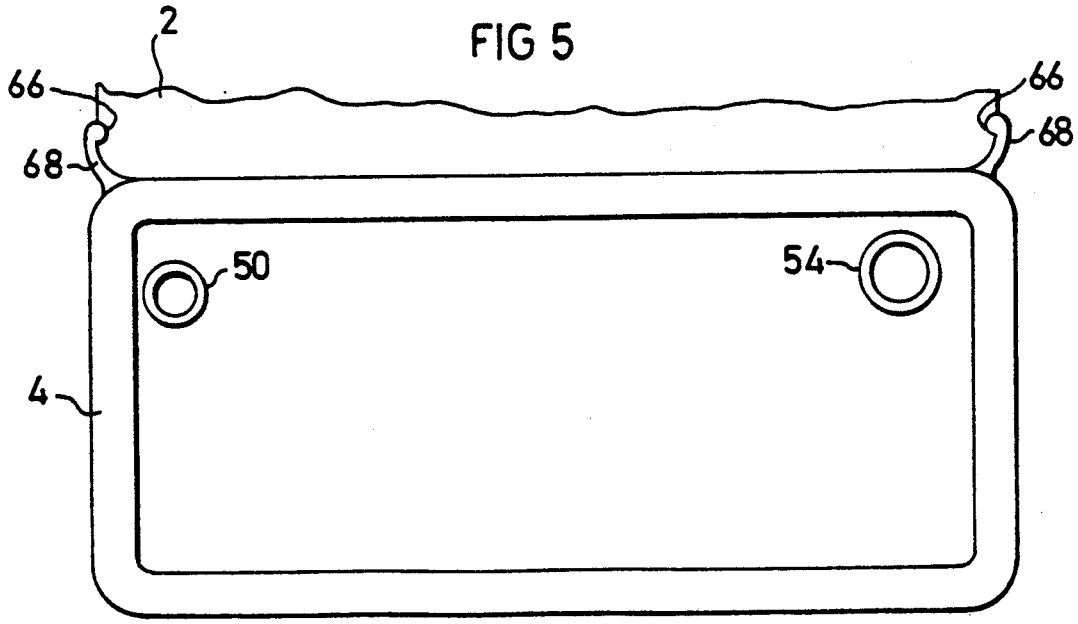
FIG. 5 is a top plan view of the collection container of FIG. 4 with a fragment of the pump housing illustrating how the collection container may be detachably secured thereto.

Pump housing 2 is further formed with a pair of recesses 66 extending along its opposite end walls adjacent one side wall of the housing, and for the height of the housing, as shown particularly in FIGS. 2 and 5. These recesses 66 are adapted to receive a pair of projecting ribs 68 (FIG. 5) formed in the collection container housing 4, to enable the collection container to be conveniently attached to and detached from the pump housing. Thus, ribs 68 may be flexible with rounded tips to facilitate applying the collection container 4 from the side of the pump housing with a snap-fit. Alternatively, ribs 68 may be rigid, whereupon the collection container would be applied by inserting it endwise and sliding it down into alignment with the pump housing.

The electronic circuitry for controlling motor 6 is contained on a printed circuit board 70 received within the pump housing 2, as shown particularly in FIG. 2. Printed circuit board 70 also includes a power socket 72 for connecting the pump to an external power supply mains, and a power switch 74 of the rocker type for turning the electric motor on and off. Printed circuit board 70, containing both socket 72 and the power switch 74, thus forms a small compact unit which may be conveniently inserted within a compartment 75 formed in the pump housing 2 for this purpose and secured therein by fasteners 76.

The manner of using the vacuum pump illustrated in FIGS. 1–4 will now be described.

The pump may be preset for any preselected vacuum by rotating knob 44 of plug 41 to cause the flat leaf spring 45 to engage the appropriate projection 46*a*–46*f* (FIG. 3*a*), according to the maximum vacuum desired to be produced by the pump. The negative-pressure port 14 of the pump is then connected by flexible tube 52 (FIG. 1) to the negative-pressure port 50 of the collection container 4; and negative-pressure port 54 of the collection container is connected to the object to be subjected to the vacuum.

Motor 6 is then energized to cause piston 8 to reciprocate within cylinder 10. During the reciprocations of piston head 32 within cylinder 10, umbrella valve 16 produces a negative pressure at port 14, which is applied to the object via tube 52 and collection container 4, whereas umbrella valve 20 air to the atmosphere. As described earlier, the noise produced by the exhaustion of the air is substantially reduced because port 18 is located in the bottom wall of the pump housing 2, the latter being raised by feet 24, and also because port 18 is connected to its respective valve by passageway 24 formed with a plurality of bends.

During the operation of the pump, if the vacuum produced exceeds the maximum value preset by relief valve 40, plug 41 of the latter valve will move inwardly to unseat its seal 43 from the inner face of housing 2, thereby releasing some of the vacuum within the housing until the preset maximum vacuum is restored. If the liquid drawn into the collection container 4 rises to the level of port 50, the elastomeric strip 60 will move upwardly to close port 50 and thereby to prevent liquid in container 4 from being drawn into the pump housing.

Figure 6:
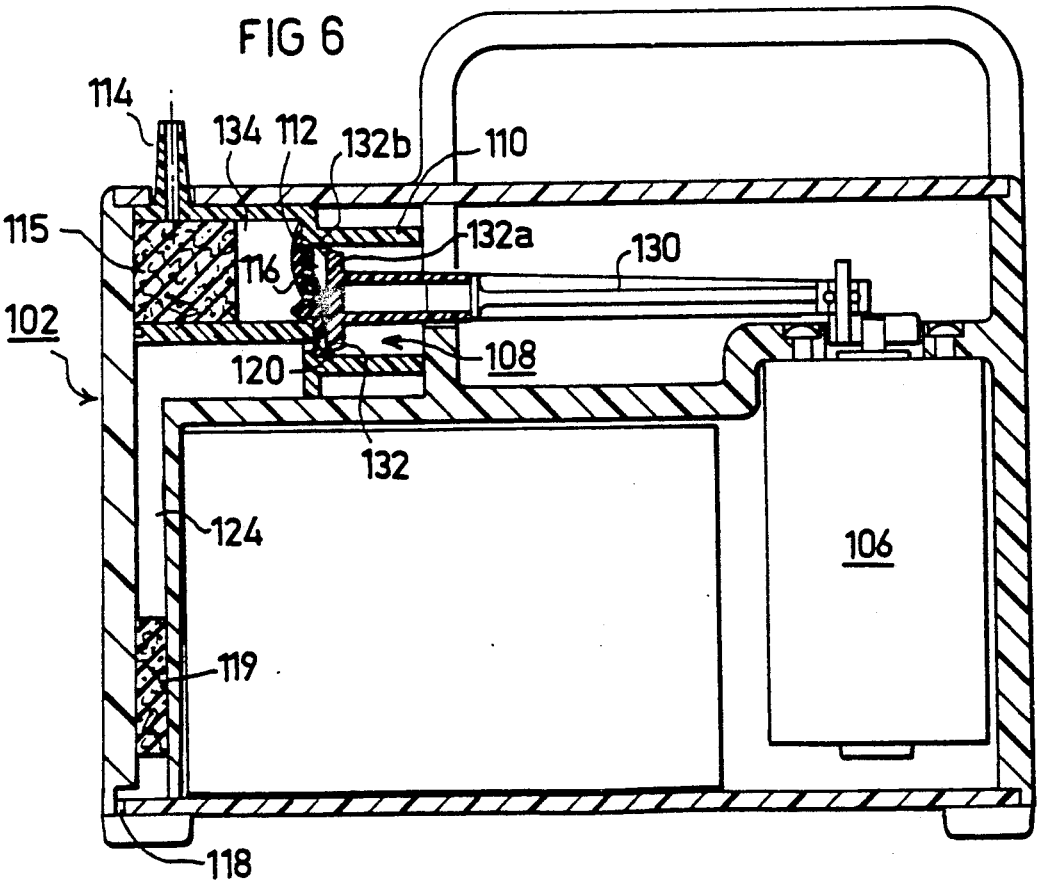
FIG. 6 is a sectional view illustrating the pumping device of FIG. 1 but slightly modified to produce a positive pressure at the outlet port.
Figure 4:
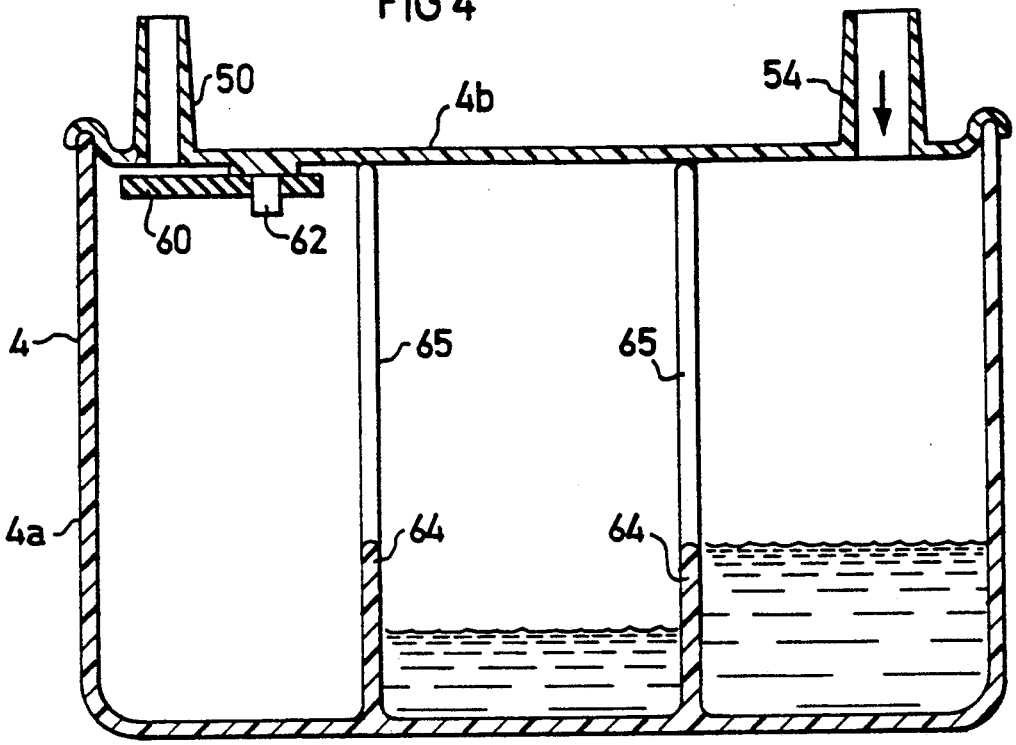
FIG. 4 is a longitudinal sectional view through the collection container attached to the pumping device of FIG. 1.

The Embodiment of FIG. 6

The pump illustrated in FIG. 6 is of basically the same construction as that described with respect to FIGS. 1–5, except that the pump is used as a compressor. Thus, it produces a positive pressure at the output port, therein designated 114, and draws air via an inlet port 118 at the bottom of the housing. For this purpose, the two umbrella valves are reversed. Thus, umbrella valve 116, communicating with port 114, is oriented to permit air to flow only from the pumping chamber 112 outwardly into chamber 134 communicating with the outlet port 114; similarly, valve 120 is oriented to permit air to flow only from the inlet passageway 124 connecting port 118 to the pumping chamber 112.

The positive-pressure outlet port 114 may be connected to a nebulizer, vaporizer, or the like, operated by the flow of pressurized air from port 114. In this construction, a filter body 115 is included within chamber 134 leading to the positive-pressure port 114 to filter the outletted air and also to muffle the noise produced during the operation of the pump. Another filter 119 is included in passageway 124 leading from the inlet port 118, also to filter the inletted air and to muffle the noise produced by the flow of air through passageway 124.

In the construction illustrated in FIG. 6, the drive may also be the same as described above with respect to FIGS. 1-5, including a motor 106 driving a piston 108 within a cylinder 110 to produce positive and negative pressures within pumping chamber 112 during the reciprocations of the piston. The piston stem 130 and piston head 132 are of the same construction as described above, including a central rigid section 132*a* of smaller diameter than the inner diameter of the cylinder 110, and an outer flexible rim 132*b* of frusto-conical configuration slidably engageable with the inner face of the cylinder. In this construction, however, the frusto-conical flexible rim 132*b* is turned inwardly towards the pumping chamber 112, rather than away from the pumping chamber as described above with respect to FIGS. 1-5.

In all other repects, the construction of the positive-pressure pump illustrated in FIG. 6 is substantially the same as described above with respect to the negative-pressure pump illustrated in FIGS. 1-5.

While the invention has been described with respect to two preferred embodiments, it will be appreciated that various other modifications, variations and applications of the invention may be made.

What is claimed is:

1. A portable fluid pumping device, comprising:

a pump housing having a fluid inlet port, a fluid outlet port, a passageway between said ports, and a cylinder in said passageway;

a piston having a piston stem and a piston head reciprocatable within said cylinder;

a valve assembly in said passageway to produce a positive pressure at one of said ports and a negative pressure at the other of said ports;

a drive coupled to said piston stem for reciprocating the piston head within said cylinder;

and a relief valve determining the degree of suction producible in the pump housing:

characterized in that said relief valve includes presettable means comprising:

an opening in said pump housing;

a plug slidably and rotatably movable within said opening and carrying a seal ring on the end of the plug disposed within the pump housing;

and a leaf spring fixed at its center to said plug so as to rotate therewith, and having outer ends engageable with the outer face of the pump housing around said opening;

said outer face of the pump housing around said opening having a projecting formation projecting at different heights from the surface of the pump housing such that rotation of the plug causes the outer ends of the spring to engage different portions of said projecting formation and thereby presets the negative pressure produced by said negative-pressure port by presetting the outward force applied by the spring to the plug in opposition to the inward force applied to the plug by the negative pressure in the pump housing.

2. The device according to claim 1, wherein said piston head includes a central section of smaller diameter than the inner diameter of the cylinder, and a peripheral flexible section slidably engageable with the side wall of the cylinder during the reciprocation of the piston;

said drive including an electric motor having a rotary drive shaft, and an eccentric bearing freely received on the rotary drive shaft and eccentrically coupling the rotary drive shaft to the piston stem.

3. The device according to claim 2, wherein said peripheral flexible section of the piston head is of frusto-conical configuration.

4. The device according to claim 3, wherein said central section of the piston head is substantially rigid and is of greater thickness than said peripheral flexible section.

5. The device according to claim 2, wherein said pump housing further includes a printed circuit board containing an electric circuit controlling the electric motor, a socket for connecting the electric circuit to a supply mains, and an ON-OFF switch.

6. The device according to claim 2, wherein said pump housing includes a plurality of feet for supporting the pump housing on a supporting surface with the bottom of the so-supported housing spaced above the supporting surface; and wherein the port at which the positive pressure is produced is located at the raised bottom of the housing and is connected to the valve assembly by at least one bend in said passageway.

7. The device according to claim 6, wherein there are a plurality of bends in the portion of the passageway connecting the positive pressure port to the valve assembly.

8. The device according to claim 2, wherein said projecting formation includes a plurality of discrete projections of different heights arranged in a circular array around said opening.

9. The device according to claim 2, further including a liquid collection container having a first negative-pressure port connected to the port of the pump housing wherein a negative pressure is produced, and a second negative-pressure port connectible to an object for drawing waste liquids from the object by suction.

10. The device according to claim 9, wherein said collection container further includes a cut-off valve effective to disconnect said first negative-pressure port of the collection container from the negative-pressure port of the pump housing; said cut-off valve comprising a strip of elastomeric material mounted at one end in cantilever fashion on the inner face of the collection container with the opposite end underlying said first negative-pressure port, such that when the collection container becomes full with liquid, the liquid will displace said opposite end of the elastomeric strip against the wall of the collection container to close said first negative-pressure port.

11. The device according to claim 9, wherein said collection container is formed with a plurality of partitions rigidifying the container and dividing its interior into a plurality of compartments, said partitions including slots extending from the top wall but terminating short of the bottom wall of the collection-container to permit liquids collected therein to pass via the slots to fill all the compartments.

12. The device according to claim 9, wherein said pump housing is formed with a pair of recesses in its outer surface at opposite sides of the housing, and the collection container includes a pair of projecting ribs slidably receivable in said recesses for removably attaching the collection container to the pump housing.

13. The device according to claim 1, wherein said projecting formation includes a plurality of discrete projections of different heights arranged in a circular array around said opening.

14. A portable fluid pumping device, comprising:

a pump housing having a fluid inlet port, a fluid outlet port, a passageway between said ports, and a cylinder in said passageway;

a piston having a piston stem and a piston head reciprocatable within said cylinder;

a valve assembly in said passageway to produce a positive pressure at one of said ports and a negative pressure at the other of said ports;

a drive coupled to said piston stem for reciprocating the piston head within said cylinder;

and a liquid collection container having a first negative-pressure port connected to the negative-pressure port of the pump housing wherein a negative-pressure is produced, a second negative-pressure port connectible to an object for drawing waste liquids from the liquids by suction, and a shut-off valve effective to disconnect said first negative-pressure port of the collection container from the negative-pressure port of the pump housing;

said shut-off valve comprising a strip of elastomeric material mounted at one end in cantilever fashion on the inner face of the collection container with the opposite end underlying said first negative-pressure port, such that when the collection container becomes full with liquid, the liquid will displace said opposite end of the elastomeric strip against the wall of the collection container to close said first negative-pressure port.

* * * * *